US005730163A

United States Patent [19]

Meyer et al.

[11] Patent Number: 5,730,163

[45] Date of Patent: Mar. 24, 1998

[54] AUTOMATICALLY OPERATING CLEANING INSTALLATION FOR WORKPIECES

[75] Inventors: Otfried Meyer, Nideggen; Karl-Heinz Wueller, Simmerath, both of Germany

[73] Assignee: Dürr Ecoclean GmbH, Filderstadt, Germany

[21] Appl. No.: 752,609

[22] Filed: Nov. 19, 1996

[30] Foreign Application Priority Data

Nov. 25, 1995 [DE] Germany ..... 195 44 074.9

[51] Int. Cl.[6] ..... B08B 3/10

[52] U.S. Cl. ..... 134/102.2; 134/108; 134/122 R; 134/199

[58] Field of Search ..... 134/102.1, 102.2, 134/108, 109, 122 R, 199, 198, 200, 100.1; 28/167

[56] References Cited

U.S. PATENT DOCUMENTS

| | | | |
|---|---|---|---|
| 3,037,887 | 6/1962 | Brenner et al. | 134/102.2 |
| 3,989,231 | 11/1976 | Randerson | 134/199 |
| 4,787,404 | 11/1988 | Klosterman et al. | 134/102.2 |
| 4,811,748 | 3/1989 | Murao et al. | 134/122 R |
| 5,603,826 | 2/1997 | Welch | 134/108 |

*Primary Examiner*—Amy B. Vanatta

*Attorney, Agent, or Firm*—McAndrews, Held & Malloy, Ltd.

[57] ABSTRACT

In a cleaning installation for removing machining residues from workpieces comprising a cleaning station having associated therewith a channel for receiving at least one workpiece to be cleaned, a workpiece transportation device for introducing workpieces to be cleaned into the channel and for removing the cleaned workpieces from the channel, and at least one blow nozzle directed into the interior of the channel and thus onto the workpieces to be cleaned for acting upon the workpieces with a jet of blow air, in order to achieve a better cleaning effect, a cleaning liquid supplying device is provided for atomizing small amounts of a cleaning liquid into the jet of blow air.

19 Claims, 2 Drawing Sheets

AUTOMATICALLY OPERATING CLEANING INSTALLATION FOR WORKPIECES

Figure 1:
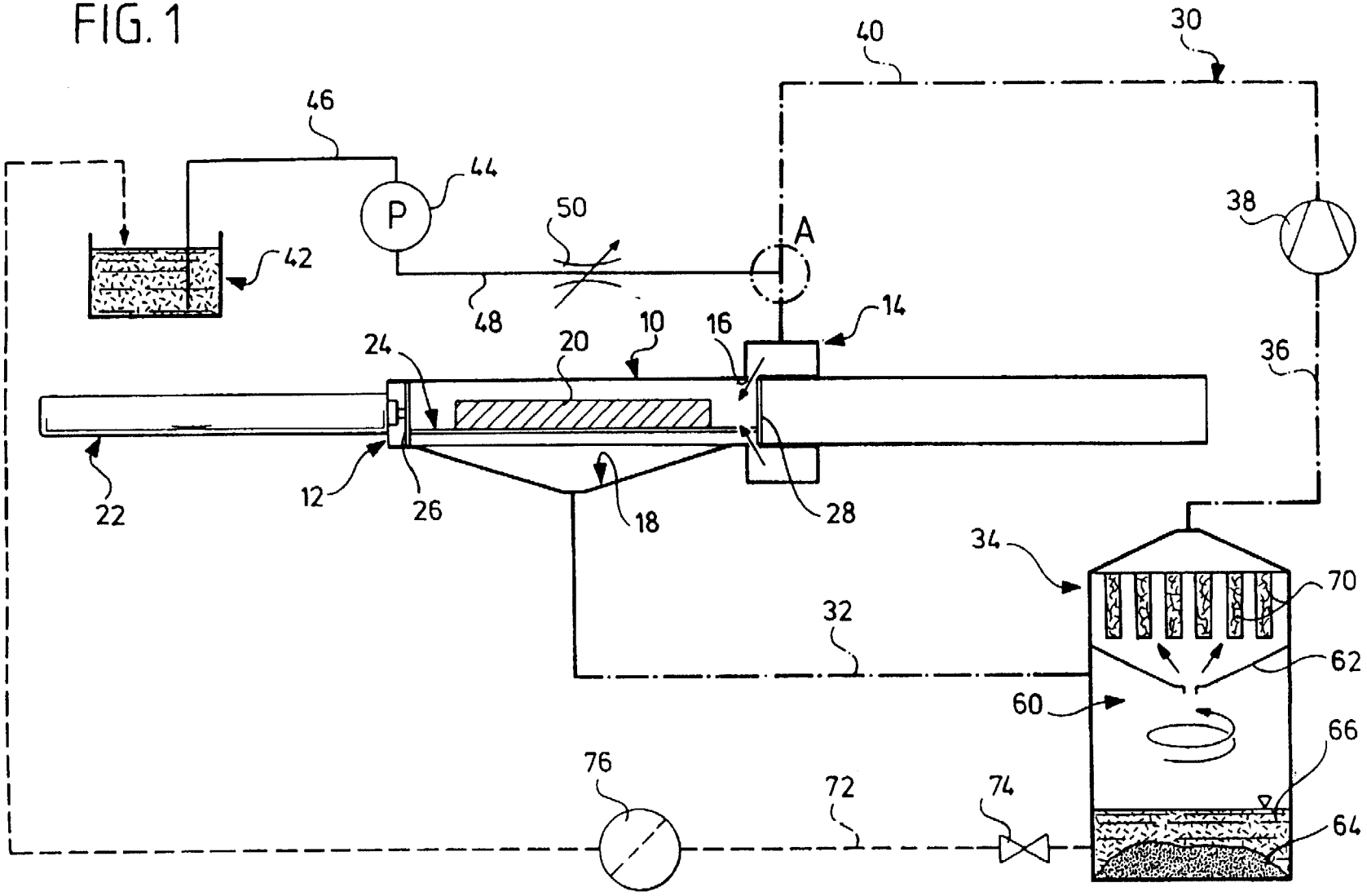

In many cases, workpieces, in particular, such as have been machined by grinding, drilling, milling, turning, sawing, thread cutting and the like, require thorough cleaning in order to remove chips, abrasive grains and the like, but also residues of machining fluids such as cutting and cooling oils, or other machining residues, as completely as possible.

To date, such cleaning has taken place, in practice, almost exclusively by the workpieces being cleaned with a cleaning liquid (organic solvents or aqueous cleaning liquids containing surfactants) by spraying and/or dipping and then being dried.

A primitive way of cleaning workplaces without the use of a cleaning liquid is common, in particular, in metalworking factories: After machining, the workpiece is manually blasted by means of a compressed air nozzle with the result that chips and other machining residues are blown into the environment, which results in a highly disturbing soiling of the working area.

A cleaning installation with which dust is to be blown off the surfaces of workpieces such as, for example, vehicle bodies to be painted, is already known from DE-A-34 19 028. This known installation is provided with a channel-type lock chamber which can be closed at both of its ends by a lift gate at the inlet side and a lift gate at the outlet side. Arranged in the lock chamber is a roller conveyor which extends over the entire length of the lock chamber and on which the articles to be cleaned are deposited and with which the articles are moved through the lock chamber. This known installation is also provided with an air circuit system with a fan for conveying air to two ring-shaped blow air channels which are arranged in spaced relation to one another in the longitudinal direction of the channel forming the lock chamber, and each of which is formed by four straight segments which protrude into the interior of the channel forming the lock chamber. Between the two blow air channels, the lock chamber is provided with a likewise ring-shaped air suction channel which is followed by two mechanical air filters connected one behind the other, from which the fan draws in the air again. The workpieces to be cleaned are conveyed in a clocked manner through the lock chamber with the aid of the roller conveyor. For this purpose, the lift gate on the inlet side is first opened, a first workpiece to be cleaned or a first batch of workpieces to be cleaned is then introduced into the lock chamber and deposited on the roller conveyor. After reaching a first position before the first blow air channel, the lift gate on the inlet side is closed, the air circuit is then set in operation, and the workpiece or workpieces conveyed through the first ring-shaped blow air channel and stopped before the second ring-shaped blow air channel. The lift gate on the inlet side is then opened again, the lock chamber charged with the next batch, the lift gate on the inlet side then closed again and the roller conveyor moved on by one step, with the first batch passing through the second ring-shaped blow air channel and the second batch through the first blow air channel, etc. Therefore, the workpieces to be cleaned must be introduced individually or in batches into the lock chamber, i.e., this known cleaning installation can only operate intermittently. In addition, relatively complicated workpiece handling devices are necessary to take the workpieces to be cleaned through the opened lift gate on the inlet side and deposit them on the roller conveyor and to remove the cleaned workpieces from the roller conveyor and take them through the opened lift gate on the outlet side.

However, the cleaning installation known from DE-A-34 19 028 is basically unsuitable for many and, in particular, the uses mentioned at the outset, because it is not possible with jets of blow air to remove dried or oily/fatty dirt, as is often typical of machined workpieces, to a sufficient extent from such workpieces. On the other hand, workpiece cleaning by means of jets of blow air does, of course, have the advantages that there is no subsequent drying of the workpieces involved, and that it is also not necessary to convey and recondition again and again large amounts of cleaning liquid, as is necessary with the cleaning of workpieces with a cleaning liquid by means of dipping and/or spraying.

The object underlying the invention was to make use, in an automatically operating cleaning installation, of the advantages of cleaning the workpieces with jets of blow air, in particular, that of dispensing with involved workpiece drying, and that of relatively low energy consumption, but at the same time, to clearly improve the cleaning effect.

The basic concept underlying the invention is to add to the jet of blow air carrying out the cleaning a relatively small amount of cleaning liquid in such a way that the jet of blow air impinging on a workpiece to be cleaned contains the cleaning liquid at least predominantly in droplet form so that with each of the droplets carried along by the blow air, a considerable pulse can be transmitted to the dirt to be removed. Nevertheless, on account of the small amount of cleaning liquid thus added to the blow air, the workpieces only become somewhat damp during the cleaning and so it is not necessary for the cleaning to be followed by involved drying of the workpieces.

Proceeding from an automatically operating cleaning installation for removing machining residues from workpieces comprising a cleaning station having associated therewith a channel for receiving at least one workpiece to be cleaned, a workpiece transportation device for introducing the workpieces to be cleaned into the channel and for removing the cleaned workpieces from the channel, and at least one blow nozzle directed into the interior of the channel and thus onto the workpieces to be cleaned for acting upon the workpieces with a jet of blow air, an air feeder for supplying air to the blow nozzle being connected to the blow nozzle upstream thereof, and the channel including an outlet for withdrawing the used blow air, the aforesaid object is structurally accomplished in accordance with the present invention in that the air feeder is designed such that it conveys per blow nozzle at least approximately 600 $m^3/h$ of air at a pressure of at most approximately 0.5 bar, in that a cleaning liquid supplying device is provided for atomizing per blow nozzle approximately 3–15 ltr/h of a cleaning liquid into the jet of blow air downstream of the air feeder, and in that a separating device is provided for separating used cleaning liquid from the used blow air.

With those means with which used cleaning liquid can be separated from the blow air in the inventive cleaning installation, oily and other machining residues and the like carried along by the used blow air can also be separated from the used blow air, and so it is, in principle, possible to conduct the used blow air into the environment or into the open. Furthermore, only comparatively small amounts of used cleaning liquid accumulate and have to be disposed of or reconditioned. In particular, the dirt removed from the workpieces can be easily separated from the used cleaning liquid with a conventional centrifugal cyclone separator and so it is readily possible to employ the used cleaning liquid again after appropriate reconditioning, although the small amounts of cleaning liquid required for cleaning according to the invention also allow economic disposal of used cleaning liquid.

It has also been found that water to which, at the utmost, small amounts (up to approximately 10% at most) of a chemical cleaning agent, in particular, surfactants, are added, can be used as cleaning liquid for the cleaning according to the invention. Although the cleaning according to the invention brings about a very good cleaning effect, it is carried out extremely gently, and so, for example, the paint on a painted workpiece surface remains undamaged.

The air feeders required for cleaning workpieces with jets of blow air heat the conveyed air to a considerable extent, above all, when the air used for the cleaning is circulated in a circuit. However, blasting with hot air has a disadvantageous effect on some workpieces, in particular, on workpieces made of certain plastics, a disadvantage which is avoided in the cleaning according to the invention by the cleaning liquid atomized into the blow air downstream of the air feeder bringing a cooling effect with it. On the other hand, heating of the cleaned workpieces has the effect of rapidly drying the workpieces which have previously become damp during the cleaning.

Finally, the means to be provided in accordance with the invention can readily be fitted subsequently in each cleaning installation operating with jets of blow air, and since the air feeder is not to convey the blow air to the blow nozzle under high pressure (at most, approximately 0.5 bar, even better, at most, 0.3 bar), the energy requirement of the cleaning installation is relatively low.

It has already been mentioned above that, in particular, in the metalworking industry it is common to blast workpieces manually with a compressed air nozzle after machining, with the result that chips and other machining residues are blown into the environment and thereby cause considerable soiling of the working area. The cleaning device in the form of a hand gun supplied with compressed air, based on the same principle, and known from DE-A-42 23 006, also has this disadvantage. For treating the workpieces, this cleaning device is provided with means which allow an optional amount, also a very small, precisely metered amount, of liquid to be added to the jet of compressed air, or compressed air and liquid to act one after the other and in an optional sequence on the workpieces. When the liquid is added to the jet of compressed air, the liquid is to be atomized.

For the sake of completeness, reference is also made to DE-31 30 560-A1 which relates to a completely different field, namely to the cleaning of agricultural products soiled with earth once they are harvested. According to this prior art, the agricultural products are cleaned in the field with compressed air which is generated by means of a high-pressure pump, namely a rotary piston compressor. Water is added to the air taken in by the high-pressure pump in order to "lubricate" the high-pressure pump with the water, and, in addition, to "harden" the jet of compressed air with the water. The water is introduced from a pressureless pipe into a suction channel of the air-high-pressure pump, i.e., not, for example atomized into the jet of air generated by the high-pressure pump, and as the water is conducted through the high-pressure pump nothing can be said about the particle size of the water in the jet of compressed air downstream of the high-pressure pump. DE-31 30 560-A1 also contains a description of prior art (DE-29 29 376-A1) which is to be improved by the invention according to DE-31 30 560-A1, and according to which water is introduced into the jet of compressed air behind the air-high-pressure pump, more specifically, directly in a compressed air nozzle. In DE-31 30 560-A1, fault is found with a low cleaning effect in this prior art which is caused by the water being able to take up only little kinetic energy and withdrawing from the jet of compressed air the kinetic energy required for accelerating the water.

The cleaning liquid can be atomized into the jet of blow air upstream of the blow nozzle. It can, however, be advantageous to atomize the cleaning liquid into the blow air at as short a distance as possible before or even within the blow nozzle in order that the small amounts of liquid added to the blow air will impinge on the workpieces to be cleaned to as great an extent as possible in droplet form, i.e., that as little cleaning liquid as possible will evaporate beforehand. As organic or other liquids which pollute the environment do not have to be used in the invention, the channel does not have to be a channel which is closed at its circumference. Therefore, it could, for example, have a U-shaped cross section and be open at the top or it could be formed only by two splash guard walls at the sides extending parallel to each other in the direction of movement of the workpieces. However, embodiments are preferred wherein the channel is closed on all sides except for an inlet opening and an outlet opening or a single inlet and outlet opening for the workpieces. Such embodiments enable further improvement of the cleaning installation according to the invention by the blow air being circulated at least almost entirely in the circuit. A corresponding embodiment is characterized by a closed blow air circuit comprising the channel and the air feeder, the blow nozzle and the liquid separating device (not taking into account that extremely small amounts of blow air can escape through the inlet and outlet opening of the channel). As mentioned above, the cleaning liquid is to be present in the jet of blow air at least predominantly in droplet form, and it is, therefore, unproblematic to separate the used cleaning liquid including dirt, for example, at a baffle wall, from the blow air circulated in the circuit after the cleaning station. It may be recommendable to reduce the moisture content of the blow air circulated in the circuit by a small part being removed continuously or periodically (even if it is only in the course of the loading and unloading of workpieces into and from the chamber) from the blow air circulated in the circuit and replaced by ambient air, or by the blow air circuit comprising a condenser for cleaning liquid vapor (where appropriate, this condenser may also be formed by "cold" walls of the blow air circuit system).

In order that the air feeder will be impaired as little as possible by the used cleaning liquid and the dirt contained therein, it is recommended that the liquid separating device be arranged downstream of the outlet of the channel and upstream of the air feeder, and to separate from the blow air before the air feeder dirt which has also been carried along by the actual blow air, it is recommended that a dirt separating device for separating from the blow air dirt removed from the workpieces also be provided in the blow air circuit downstream of the outlet of the channel and upstream of the air feeder. This dirt separating device may be a simple mechanical filter. Differently from the cleaning installation known from DE-A-34 19 028, for the cleaning installation according to the invention it is recommended that the outlet of the channel be arranged at a bottom of the channel in order to take into account the fact that the walls of the channel act as baffle walls for the cleaning liquid droplets carried along by the blow air, i.e., as liquid separating elements.

The blow air nozzle or several blow air nozzles could be held by a robot-like handling device and moved along the workpieces to be Gleaned and/or around these. However, it is simpler to design the blow nozzle such that it has an air outlet opening at least essentially surrounding the workpiece to be cleaned and blow nozzle and workpiece are moved relative to each other transversely to this air outlet opening, more specifically, by the workpieces being guided by the transportation device through the blow nozzle. For this reason, it may be expedient to design the workpiece transportation device such that it comprises an endless conveyor element extending through the channel and then also extending through the air outlet opening of the blow nozzle. In particular, the channel and the workpiece transportation device can be designed as described and/or claimed in the unpublished DE-44 25 765-A1 (older patent application P 44 25 765.1) of Dürr GmbH. Alternatively, the workpiece transportation device can also have a slide-like workpiece carrier which pushes the workpieces into the channel and pulls them out again, with the workpieces passing through the blow nozzle(s). In any case, it is particularly advantageous for the area of the transportation device carrying the workpiece to be permeable to air transversely to the longitudinal direction of the channel as the blow air can then be directed from all directions onto the workpieces carried by the transportation device.

The cleaning liquid to be atomized into the blow air could be sucked into the jet of blow air via an appropriately designed nozzle and atomized, and this nozzle could be designed such that it also serves to meter the cleaning liquid. However, embodiments wherein the cleaning liquid supplying device is provided with a metering pump and/or a metering valve for metering the cleaning liquid to be atomized into the jet of blow air are functionally more reliable and, therefore, preferable.

The simplest way of measuring the amount of liquid to be atomized into the jet of blow air is with a metering pump and/or a metering valve.

As described above, the cleaning effect of the cleaning liquid is mainly due to the fact that the liquid droplets can transmit considerable pulses to the workpiece surfaces to be cleaned and, therefore, even pure water can be used for cleaning in accordance with the invention. For stubborn soiling, it may, however, prove expedient to use water containing up to approximately 3% by volume, preferably 1 to 2% by volume, of a detergent surfactant, as cleaning liquid.

The nozzle atomization of small amounts of a cleaning liquid into the jet of blow air makes it possible to supply the blow air to the blow nozzle with a relatively low overpressure, and so, in preferred embodiments of the cleaning installation according to the invention, the air feeder is designed such that the air is supplied to the blow nozzle at a pressure of at most approximately 0.3 bar, preferably only approximately 0.2 bar. It has, however, been found that even at a pressure of only approximately 0.1 bar, good cleaning effects are still achievable.

Further features, advantages and details of the invention are apparent from the enclosed claims and/or the following description and the appended drawings of a particularly advantageous embodiment of the cleaning installation according to the invention. The drawings show:

FIG. 1 a schematic illustration of the cleaning installation; and

Figure 2:
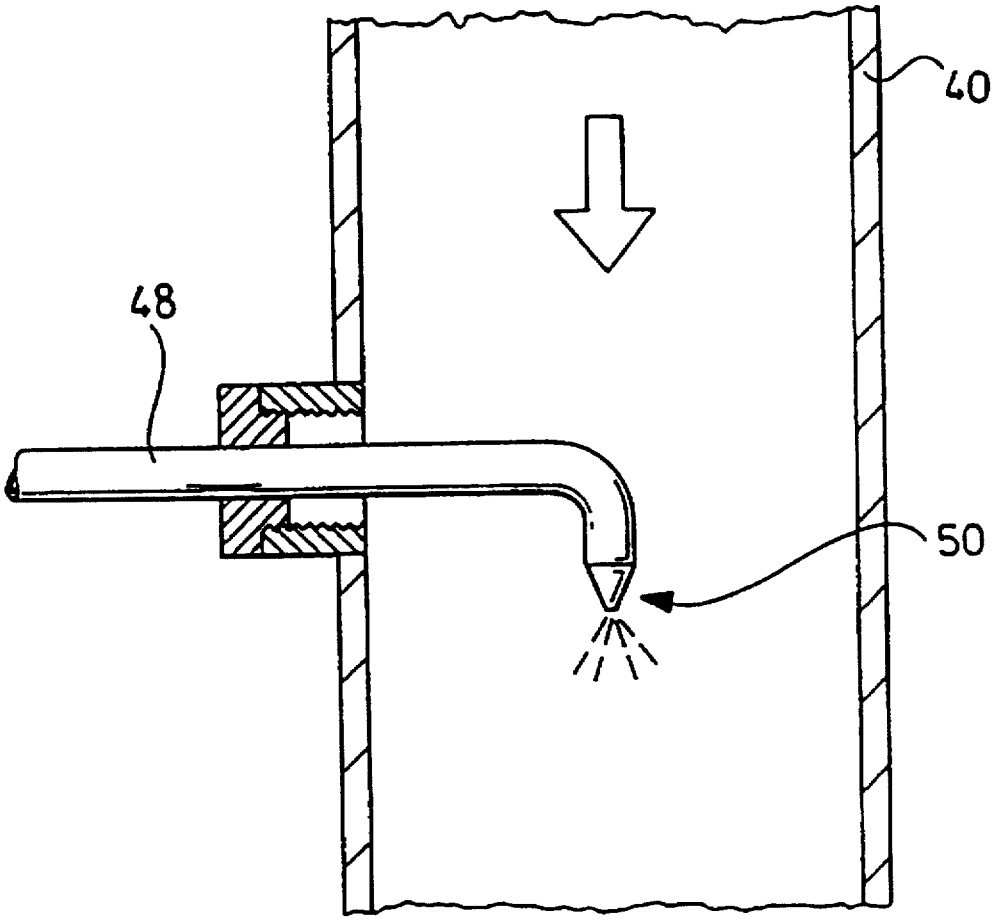

FIG. 2 the section designated "A" in FIG. 1 in detail and on a larger scale.

The cleaning installation illustrated in its entirety in FIG. 1 comprises a channel 10 which is closed throughout its circumference—except for openings to be described hereinbelow—but is open at both of its end faces. The left end face according to FIG. 1 thus forms an inlet/outlet opening 12 for the workpieces to be cleaned. Approximately at the center thereof, the channel 10 is surrounded by a ring-shaped blow nozzle 14 comprising a likewise ring-shaped nozzle opening 16 indicated by arrows—the wall of the channel 10 has a ring-shaped slot at this location. The blow nozzle 14 does, therefore, not protrude into the interior of the channel 10 and is preferably designed such as described and illustrated in patent application Ser. No. P 44 25 765.1. As indicated by the arrows in FIG. 1, the nozzle opening 16 is oriented such that the blow nozzle 14 generates a ring-shaped jet of blow air which is directed into the interior of the channel 10 and is inclined somewhat in the direction towards the inlet/outlet opening 12.

On the left of the blow nozzle 14 according to FIG. 1, the bottom of the channel 10 is formed by a suction funnel 18, whereas the inner cross section of the channel 10 is otherwise constant throughout its entire length.

Associated with the inlet/outlet opening 12 is a workpiece transportation device with which a workpiece 20 to be cleaned can be introduced into the channel 10 through the inlet/outlet opening, pushed through the nozzle opening 16 and then pulled out of the channel 10 again. This workpiece transportation device comprises a slide rod 22 extending in the longitudinal direction of the channel 10. The slide rod 22 is held by means, not illustrated, and can be pushed back and forth in the longitudinal direction of the channel 10. The workpiece transportation device also comprises a workpiece carrier 24 which is held by the slide rod 22 and has attached to each of its two ends a partition 26 and 28, respectively. The workpiece carrier 24 forms a support which is of air-permeable design in the vertical direction for a workpiece 20 to be cleaned, whereas the two partitions 26 and 28 are air-impermeable and—except for the area of the suction funnel 18—can slide sealingly along the inside wall of the channel 10. In accordance with the invention, the workpiece carrier 24 is of such length that after introduction of a workpiece 20 to be cleaned into the channel 10, in the initial position of the workpiece carrier illustrated in FIG. 1, the partition 28 is located somewhat behind, i.e., according to FIG. 1 on the right of the nozzle opening 16, for the cleaning operation, whereas the partition 26 is located approximately at the left end of the suction funnel 18 according to FIG. 1.

The channel 10 including the blow nozzle 14 is a component of an at least essentially closed blow air circuit 30, the parts of which will be described hereinbelow:

There is located at the bottom of the suction funnel 18 an outlet opening, not illustrated in further detail, to which a first exhaust line 32 is connected. The exhaust line 32 leads to a barrel-shaped separating device 34 having at the top side thereof an outlet opening, not illustrated in further detail, to which a second exhaust line 36 is connected. The exhaust line 36 connects the separating device 34 to the suction side of a blow air ventilator 38, to the outlet of which a blow air line 40 is connected. The blow air conveyed by the ventilator 38 is supplied by this blow air line 40 to the blow nozzle 14.

A cleaning liquid to be used in the cleaning process is stored in a cleaning liquid tank 42. By means of a metering pump 44 and a suction line 46, cleaning liquid is drawn out of the cleaning liquid tank 42 and conveyed into a pressure line 48 comprising an adjustable metering valve 50. As shown in FIG. 2, the pressure line 48 leads in a sealed manner into the blow air line 40 and terminates there in a nozzle 50, with the aid of which the cleaning liquid is atomized into the flow of blow air a short distance before the blow nozzle 14, more specifically, in such a way that the flow of blow air carries along with it essentially in droplet form the metered cleaning liquid which has been added to it. The nozzle atomization of the cleaning liquid somewhat upstream of the ring-shaped blow nozzle 14 has the advantage that a single nozzle 50 suffices, and there is no necessity for further nozzles to be distributed over the circumference of the blow nozzle 14.

The separating device 34 comprises approximately half way up it a centrifugal cyclone separator 60, which can be of a design known per se, and, therefore, does not need to be described in detail or illustrated in the drawing. It serves to separate from the flow of blow air drawn out of the channel 10 by the ventilator 38 via the exhaust line 32 droplets of cleaning liquid and dirt which was removed from the cleaned workpiece, more specifically, with the aid of centrifugal forces which are generated by the blow air to be cleaned forming a vortex in the centrifugal cyclone separator 60, more particularly, below an approximately funnel-shaped partition wall 62 of the separating device 34. Solid particle dirt 64 originating from the cleaned workpiece then deposits at the bottom of the separating device 34, while cleaning liquid 66 soiled, for example, by cutting oils, settles above the solid particle dirt 64 in the separating device 34. The blow air cleaned by the centrifugal cyclone separator 60 travels through an opening at the center of the partition wall 62 into the upper part of the separating device 34 where it passes through exchangeably arranged filter candles 70, and the thus further cleaned blow air then enters the exhaust line 36.

Somewhat above the deposited solid particle dirt 64, the soiled cleaning liquid 66 is withdrawn from the separating device 34, more specifically, by means of a discharge line 72 which preferably contains a valve 74. The discharge line 72 leads to a reconditioning device 76, shown only schematically, in which, in a manner known per se, fats, oils or other similar impurities are separated from the cleaning liquid. The reconditioning device 76 should also contain a pump with which the reconditioned cleaning liquid is conveyed back into the cleaning liquid tank 42.

Instead of a single workpiece 20, illustrated in FIG. 1, the workpiece carrier 24 can, of course, also be loaded with several workpieces to be cleaned.

After the workpiece carrier 24 has been introduced with the workpiece to be cleaned into the channel 10 and has assumed its initial position illustrated in FIG. 1, the ventilator 38 and the metering pump 44 are switched on and the workpiece carrier 24 is moved slowly from the left to the right according to FIG. 1 until all areas of the workpiece to be cleaned have passed the ring-shaped nozzle opening 16. The workpiece carrier 24 is then drawn back from the right to the left according to FIG. 1 into its initial position illustrated in FIG. 1 and pulled towards the left together with the cleaned workpiece out of the channel 10.

In order that blow air and dirt cannot escape from the interior of the channel 10 in spite of the suction funnel 18, the slide rod 22 can be replaced by a double acting, horizontally displaceable pressure medium cylinder which is provided with a piston rod holding the workpiece carrier 24 and, in addition, with a partition which, after the workpiece carrier 24 has been pushed into the channel 10, closes the left end of the channel 10 in accordance with FIG. 1 in an air-tight manner—on account of the partition 28, neither blow air nor dirt can escape from the right open end of the channel 10 during the cleaning operation.

As mentioned above, the channel and the workpiece transportation device could, however, also be designed as described and/or claimed in application Ser. No. P 44 25 765.1.

What is claimed is:

1. Automatically operating cleaning installation for removing machining residues from workpieces comprising a cleaning station having associated therewith a channel for receiving at least one workpiece to be cleaned, a workpiece transportation device for introducing said workpieces to be cleaned into said channel and for removing said cleaned workpieces from said channel, and at least one blow nozzle directed into the interior of said channel and thus onto said workpieces to be cleaned for acting upon said workpieces with a jet of blow air, an air feeder for supplying air to said blow nozzle being connected to said blow nozzle upstream thereof, and said channel including an outlet for withdrawing the used blow air, characterized in that said air feeder (38) is designed such that it conveys per blow nozzle (14) at least approximately 600 $m^3/h$ of air at a pressure of at most approximately 0.5 bar, in that a cleaning liquid supplying device (50) is provided for atomizing per blow nozzle approximately 3 to 15 ltr/h of a cleaning liquid into said jet of blow air downstream of said air feeder (38), and in that a separating device (34) is provided for separating used cleaning liquid from said used blow air.

2. Installation as defined in claim 1, characterized in that except for an inlet and outlet opening (12) for said workpieces, said channel (10) is closed on all sides thereof.

3. Installation as defined in claim 2, characterized by a closed blow air circuit (30) comprising said channel (10) and said air feeder (38), said blow nozzle (14) and said liquid separator (60).

4. Installation as defined in claim 3, characterized in that said liquid separator (60) is arranged downstream of said outlet (18) of said channel (10) and upstream of said air feeder (38).

5. Installation as defined in claim 3, characterized in that said blow air circuit (30) comprises downstream of said outlet (18) of said channel (10) and upstream of said air feeder (38) a dirt separator (70) for separating from said blow air dirt removed from said workpieces.

6. Installation as defined in claim 5, characterized in that said dirt separator (70) comprises a mechanical filter.

7. Installation as defined in claim 5, characterized in that said dirt separating device (34) also forms said liquid separator (60).

8. Installation as defined in claim 6, characterized in that said dirt separating device (34) comprises a container with a lower collecting area for used cleaning liquid (66) and dirt (64), in that said filter (70) is arranged in said container above said collecting area, and in that a container inlet for the mixture of blow air and cleaning liquid is arranged between collecting area and filter, and a container outlet for blow air is arranged on the side of said filter facing away from said collecting area.

9. Installation as defined in claim 1, characterized in that said outlet (18) of said channel (10) is arranged at a bottom of the channel.

10. Installation as defined in claim 1, characterized in that said blow nozzle (14) has an air outlet opening (16) at least essentially enclosing said workpiece to be cleaned, and said blow nozzle and said workpiece are moveable relative to each other transversely to this air outlet opening.

11. Installation as defined in claim 1, characterized in that said workpiece transportation device comprises an endless conveyor element extending through said channel.

12. Installation as defined in claim 10, characterized in that said transportation device (24) extends through said air outlet opening (16) of said blow nozzle (14).

13. Installation as defined in claim 12, characterized in that an area (24) of said transportation device (22, 24) carrying said workpiece is permeable to air transversely to the longitudinal direction of said channel.

14. Installation as defined in claim 1, characterized in that said cleaning liquid supplying device comprises a metering pump (44) for metering said cleaning liquid which is to be atomized into said jet of blow air.

15. Installation as defined in claim 1, characterized in that said cleaning liquid is water containing up to approximately 3% by volume, preferably 1 to 2% by volume, of a detergent surfactant.

16. Installation as defined in claim 1, characterized in that said cleaning liquid supplying device is designed such that the jet of blow air impinging on said workpiece contains said cleaning liquid at least predominantly in droplet form.

17. Installation as defined in claim 1, characterized in that said air feeder (38) is designed such that the air is supplied to said blow nozzle at a pressure of at most approximately 0.3 bar, preferably of approximately 0.2 bar.

18. Installation as defined in claim 1, characterized in that a cleaning liquid circuit system comprising a reconditioning device (76) for used cleaning liquid is provided.

19. Installation as defined in claim 1, characterized in that said air feeder (38) is a ventilator.

* * * * *